US008128464B2

(12) United States Patent
Motonari et al.

(10) Patent No.: US 8,128,464 B2
(45) Date of Patent: Mar. 6, 2012

(54) CHEMICAL MECHANICAL POLISHING PAD

(75) Inventors: Masayuki Motonari, Yokkaichi (JP); Tomikazu Ueno, Yokkaichi (JP); Masahiro Yamamoto, Tuchiura (JP); Yuugo Tai, Yokkaichi (JP); Hiroyuki Miyauchi, Yokkaichi (JP)

(73) Assignee: JSR Corporation, Tokyo (JP)

( * ) Notice: Subject to any disclaimer, the term of this patent is extended or adjusted under 35 U.S.C. 154(b) by 540 days.

(21) Appl. No.: 12/360,967

(22) Filed: Jan. 28, 2009

(65) Prior Publication Data

US 2009/0209185 A1 Aug. 20, 2009

(30) Foreign Application Priority Data

Feb. 18, 2008 (JP) ..... 2008-035819

(51) Int. Cl.
*B24D 11/00* (2006.01)

(52) U.S. Cl. ..... 451/527; 451/526; 451/530; 451/529

(58) Field of Classification Search ..... 451/526, 451/527, 530, 529, 41, 285, 287
See application file for complete search history.

(56) References Cited

U.S. PATENT DOCUMENTS

| | | | | |
|---|---|---|---|---|
| 5,177,908 | A * | 1/1993 | Tuttle | 451/41 |
| 5,489,233 | A * | 2/1996 | Cook et al. | 451/41 |
| 5,650,039 | A | 7/1997 | Talieh | |
| 5,899,799 | A * | 5/1999 | Tjaden et al. | 451/287 |
| 5,921,855 | A | 7/1999 | Osterheld et al. | |
| 5,984,769 | A | 11/1999 | Bennett et al. | |
| 6,273,806 | B1 | 8/2001 | Bennett et al. | |
| 6,520,847 | B2 | 2/2003 | Osterheld et al. | |
| 6,645,061 | B1 | 11/2003 | Bennett et al. | |
| 6,699,115 | B2 | 3/2004 | Osterheld et al. | |
| 6,749,485 | B1 * | 6/2004 | James et al. | 451/41 |
| 6,783,436 | B1 * | 8/2004 | Muldowney | 451/41 |
| 6,783,448 | B2 * | 8/2004 | Sabo | 451/359 |
| 6,824,455 | B2 | 11/2004 | Osterheld et al. | |
| 7,131,901 | B2 * | 11/2006 | Shih et al. | 451/527 |
| 7,198,546 | B2 * | 4/2007 | Berman et al. | 451/8 |
| 7,258,708 | B2 * | 8/2007 | Sung | 51/307 |
| 2003/0119437 | A1 * | 6/2003 | Rich et al. | 451/529 |
| 2005/0070217 | A1 | 3/2005 | Shih et al. | |
| 2005/0260929 | A1 | 11/2005 | Shiho et al. | |
| 2006/0183412 | A1 * | 8/2006 | Allison et al. | 451/526 |

FOREIGN PATENT DOCUMENTS

| | | |
|---|---|---|
| JP | 8-39423 | 2/1996 |
| JP | 8-216029 | 8/1996 |
| JP | 11-70463 | 3/1999 |
| JP | 2006-196836 | 7/2006 |

* cited by examiner

*Primary Examiner* — George Nguyen
(74) *Attorney, Agent, or Firm* — Oblon, Spivak, McClelland, Maier & Neustadt, L.L.P.

(57) ABSTRACT

A chemical mechanical polishing pad used for chemical mechanical polishing comprises a polishing surface, a non-polishing surface that is provided opposite to the polishing surface, a side surface that connects an outer edge of the polishing surface and an outer edge of the non-polishing surface, and a plurality of grooves formed in the polishing surface. The side surface has a slope surface that is connected to the polishing surface, and a depth of the grooves is equal to or smaller than a height of the slope surface.

19 Claims, 4 Drawing Sheets

CHEMICAL MECHANICAL POLISHING PAD

Japanese Patent Application No. 2008-35819, filed on Feb. 18, 2008, is hereby incorporated by reference in its entirety.

BACKGROUND OF THE INVENTION

The present invention relates to a chemical mechanical polishing pad.

In recent years, a chemical mechanical polishing method (generally abbreviated as "CMP") has attracted attention as a polishing method that can form a surface having excellent flatness on a silicon substrate or a silicon substrate on which interconnects, electrodes, and the like are formed (hereinafter referred to as "semiconductor wafer") in the production of semiconductor devices, for example. The chemical mechanical polishing method polishes a polishing target surface while causing the polishing target surface to slidingly come in contact with a chemical mechanical polishing pad and supplying a chemical mechanical polishing aqueous dispersion (aqueous dispersion in which abrasive grains are dispersed; slurry) to the surface of the chemical mechanical polishing pad. In the chemical mechanical polishing method, the polishing results are significantly affected by the properties and the like of the chemical mechanical polishing pad. Various chemical mechanical polishing pads have been proposed.

For example, a polyurethane foam that contains minute bubbles is used as the chemical mechanical polishing pad, and the polishing target surface is polished in a state in which the chemical mechanical polishing aqueous dispersion is held in pores formed in the surface of the chemical mechanical polishing pad (see JP-A-11-70463, JP-A-8-216029, and JP-A-8-39423, for example).

When using such a chemical mechanical polishing pad, since the slurry is supplied to the polishing pad in a state in which a semiconductor wafer is pressed against the surface of the polishing pad, it is difficult to remove the semiconductor wafer from the surface of the polishing pad after polishing without applying load. Moreover, the adhesion between the polishing pad and a polishing platen on which the polishing pad is placed decreases due to removal of the semiconductor wafer from the surface of the polishing pad so that a friction occurs between the polishing pad and a dresser or the semiconductor wafer. As a result, the edge of the polishing pad may be removed from the polishing platen, or a polishing layer of the polishing pad may be removed from a cushion layer. Therefore, removal of the semiconductor wafer, breakage of the polishing pad, or abnormal wear of the surface of the polishing pad occurs so that the durability and the polishing capability of the polishing pad deteriorate.

In order to solve this problem, JP-A-2006-196836 discloses technology that suppresses removal problems by utilizing a polishing pad that has an outer periphery lower than the polishing surface.

However, surface defects (scratches) on a semiconductor wafer (polishing target) may not be sufficiently reduced by the technology disclosed in JP-A-2006-196836.

SUMMARY

The invention provides a chemical mechanical polishing pad that can reduce scratches that occur on a polishing target surface during polishing and has excellent durability.

According to one aspect of the invention, there is provided a chemical mechanical polishing pad used for chemical mechanical polishing, the chemical mechanical polishing pad comprising: a polishing surface; a non-polishing surface that is provided opposite to the polishing surface; a side surface that connects an outer edge of the polishing surface and an outer edge of the non-polishing surface; and a plurality of grooves formed in the polishing surface, the side surface having a slope surface that is connected to the polishing surface; and a depth of the grooves being equal to or smaller than a height of the slope surface.

In the above chemical mechanical polishing pad, an angle theta formed by the polishing surface and the slope surface inside the chemical mechanical polishing pad may be larger than 90° and smaller than 180°, the angle theta facing the non-polishing surface.

In the above chemical mechanical polishing pad, the polishing surface may be circular; the chemical mechanical polishing pad may further comprise a plurality of circular grooves formed in the polishing surface; the polishing surface may be concentric with the plurality of circular grooves; and a ratio e/d of a distance e between the outer edge of the polishing surface and the groove closest to the outer edge of the polishing surface to a distance d between adjacent grooves among the plurality of grooves may be 0.3 to 2.

In the above chemical mechanical polishing pad, the slope surface may be formed by a first slope surface and a second slope surface, an angle formed by the first slope surface and the polishing surface differing from an angle formed by the second slope surface and the polishing surface; the first slope surface may be connected to the polishing surface and the second slope surface so that an angle $theta_1$ formed by the first slope surface and the polishing surface inside the chemical mechanical polishing pad is larger than 90° and smaller than 180°, the angle $theta_1$ facing the non-polishing surface; and the second slope surface may be connected to the first slope surface so that an angle $theta_2$ formed by the second slope surface and the polishing surface inside the chemical mechanical polishing pad is larger than 90° and smaller than 180°, the angle $theta_2$ facing the non-polishing surface.

In the above chemical mechanical polishing pad, the side surface may have a first surface, a second surface, a third surface, and a fourth surface in this order from the outer edge of the polishing surface; the first surface may be connected to the polishing surface and the second surface so that an angle $theta_3$ formed by the first surface and the polishing surface inside the chemical mechanical polishing pad is larger than 90° and smaller than 180°, the angle $theta_3$ facing the non-polishing surface; the second surface may be connected to the first surface and the third surface so that an angle $theta_4$ formed by the second surface and the polishing surface inside the chemical mechanical polishing pad is smaller than the angle formed by the first surface and the polishing surface, the angle $theta_4$ facing the non-polishing surface; the third surface may be parallel to the polishing surface and connected to the second surface and the fourth surface; and the fourth surface may be connected to the third surface and the non-polishing surface so that an angle $theta_5$ formed by the second surface and the polishing surface inside the chemical mechanical polishing pad is smaller than the angle formed by the first surface and the polishing surface, the angle $theta_5$ facing the non-polishing surface.

In the above chemical mechanical polishing pad, the slope surface may be provided to surround the entire outer edge of the polishing surface.

The above chemical mechanical polishing pad comprises the polishing surface, the non-polishing surface that is provided opposite to the polishing surface, the side surface that connects the outer edge of the polishing surface and the outer edge of the non-polishing surface, and the grooves formed in the polishing surface. The side surface has the slope surface that is connected to the polishing surface, and the depth of the grooves is equal to or smaller than the height of the slope surface.

Since the chemical mechanical polishing pad comprises the grooves formed in the polishing surface, a substrate or the like can be efficiently polished using the chemical mechanical polishing pad. The chemical mechanical polishing pad maintains the polishing performance until the polishing surface wears away due to polishing so that the grooves are lost. Since the chemical mechanical polishing pad comprises the slope surface connected to the polishing surface, scratches that occur on the polishing target surface of a substrate or the like can be reduced. The slope surface is also removed due to wear of the polishing surface.

According to the above chemical mechanical polishing pad, since the depth of the grooves is equal to or smaller than the height of the slope surface, the slope surface is present when the grooves are present even if the polishing surface wears away to a large extent. Therefore, the above-mentioned scratch reduction effect can be maintained.

DETAILED DESCRIPTION OF THE EMBODIMENT

1. Chemical Mechanical Polishing Pad

Figure 1:
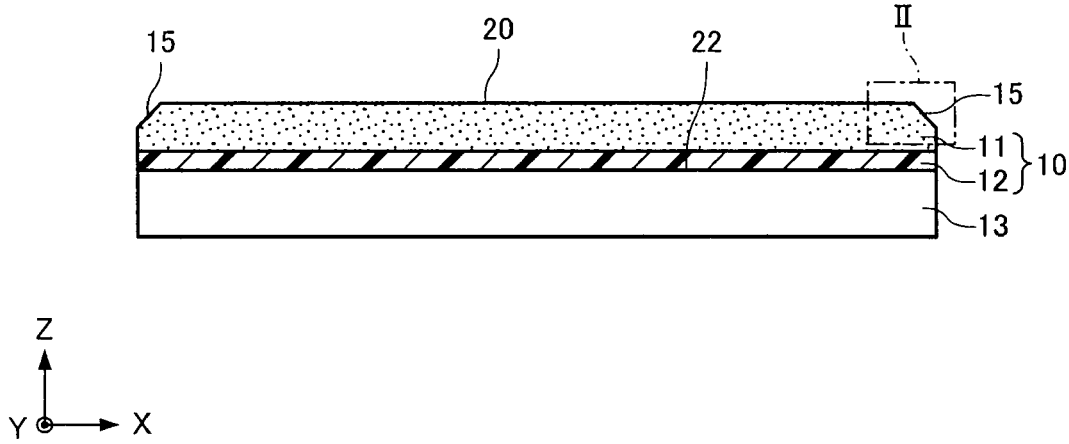
FIG. 1 is a cross-sectional view showing a chemical mechanical polishing pad according to one embodiment of the invention.

FIG. 1 is a cross-sectional view showing a chemical mechanical polishing pad according to one embodiment of the invention (grooves (described later) formed in a polishing surface are omitted in FIG. 1). A chemical mechanical polishing pad 10 according to this embodiment includes a polishing layer 11, and a support layer 12 provided between the polishing layer 11 and a platen 13 of a polishing apparatus.

The details of the polishing layer 11 and the support layer 12 are described below.

1.1. Shape of Polishing Layer

Figure 2:
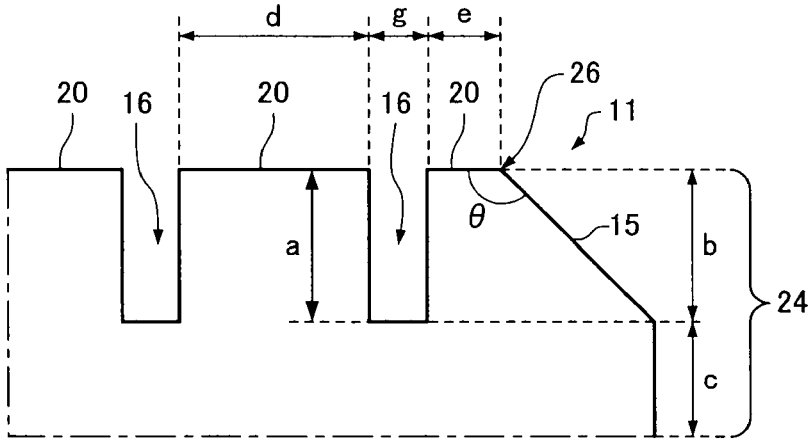
FIG. 2 is an enlarged view showing an area II shown in FIG. 1 and shows a detailed shape of a polishing layer.
Figure 7:
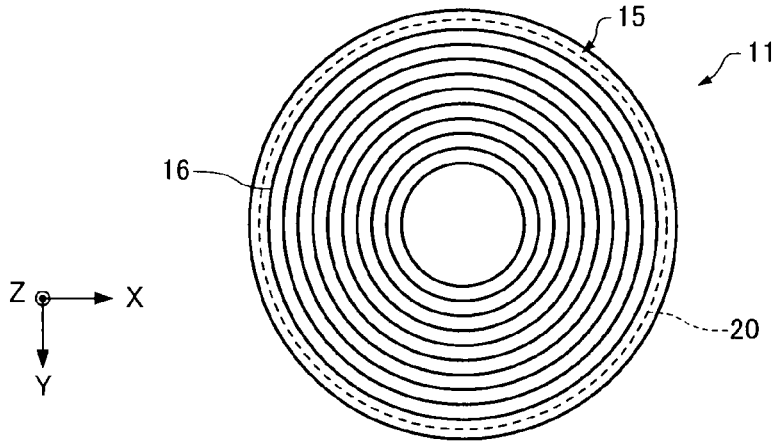
FIG. 7 is a view showing the top surface of a polishing layer 11 according to one embodiment of the invention.

FIG. 2 is an enlarged view showing an area II shown in FIG. 1. FIG. 2 is a view showing a detailed shape of the polishing layer. FIG. 7 is a view showing the top surface of the polishing layer 11. The polishing layer 11 includes a polishing surface 20 that comes in contact with a polishing target surface to implement chemical mechanical polishing, a non-polishing surface 22 that is provided opposite to the polishing surface, a side surface 24 that connects an outer edge 26 of the polishing surface 20 and an outer edge of the non-polishing surface 22, and a plurality of grooves 16 formed in the polishing surface 20. In FIG. 1, the top surface of the chemical mechanical polishing pad 10 corresponds to the polishing surface 20, and the bottom surface of the chemical mechanical polishing pad 10 corresponds to the non-polishing surface 22.

The polishing surface 20 is flat. The planar shape of the polishing layer 11 is not particularly limited. The polishing layer 11 may have a circular planar shape. The size of the polishing layer 11 is not particularly limited. For example, the polishing layer 11 may have a diameter of 150 to 1200 mm, and preferably 500 to 800 mm. The polishing layer 11 may have a thickness of 0.5 to 5.0 mm, preferably 1.0 to 3.0 mm, and more preferably 1.5 to 3.0 mm.

The polishing layer 11 of the chemical mechanical polishing pad 10 may have a plurality of grooves 16 formed in the polishing surface. The groove 16 holds a chemical mechanical polishing aqueous dispersion that is supplied during chemical mechanical polishing to uniformly distribute the aqueous dispersion over the polishing surface, and serves as a path that temporarily stores polishing waste, a spent aqueous dispersion, and the like and discharges the polishing waste and the like to the outside.

The shape of the grooves 16 is not particularly limited. As shown in FIG. 7, the grooves 16 may be a plurality of circles that gradually increase in diameter from the center of the polishing surface 20 toward the outer edge 26, for example. The circular grooves 16 may be circles or ovals that do not intersect. The grooves 16 may be polygonal or the like. As shown in FIG. 7, it is preferable that the shape of the circular grooves 16 be concentric with the shape of the polishing surface 20. The number of circular grooves 16 may be 20 to 400, for example.

In this embodiment, it is preferable that the grooves 16 have a shape that is point-symmetrical with respect to the center of the polishing layer 11 so that a pressure is uniformly applied to the center of the polishing layer 11. Therefore, the grooves 16 may have a spiral shape, a radial shape, or a combination of these shapes instead of the above-mentioned circular shape.

It is preferable that the non-polishing surface 22 of the polishing layer 11 be formed flush. This enables high mechanical strength to be maintained. If the non-polishing surface 22 is formed flush, the polishing layer 11 can be provided with a high degree of freedom relating to the formation area of the grooves 16 formed in the polishing surface 20.

The cross-sectional shape of the grooves 16 is not particularly limited. As shown in FIG. 2, the grooves 16 may have a polygonal cross-sectional shape (e.g., a rectangular cross-sectional shape), a cross-sectional shape in the shape of the letter "U", or the like. The grooves 16 have a depth a. The depth a of the grooves 16 may be 0.1 mm or more. The depth a of the grooves 16 is preferably 0.1 to 2.5 mm, and more preferably 0.2 to 2.0 mm. The grooves 16 may have a width g of 0.1 mm or more. The width g of the grooves 16 is preferably 0.1 to 5.0 mm, and more preferably 0.2 to 3.0 mm. A distance d between the adjacent grooves 16 may be identical. The distance d may be 0.05 mm or more, for example. The distance d is preferably 0.05 to 100 mm, and more preferably 0.1 to 10 mm. If the grooves 16 have dimensions within the above ranges, a chemical mechanical polishing pad that exhibits an excellent effect of reducing scratches on the polishing target surface and has a long life can be easily produced.

A pitch that is the sum of the distance d and the width g of the grooves 16 may be 0.15 mm or more. The pitch is preferably 0.15 to 105 mm, more preferably 0.5 to 13 mm, particularly preferably 0.5 to 5.0 mm, and most preferably 1.0 to 2.2 mm.

The side surface 24 has a slope surface 15 in the upper area. The slope surface 15 is continuously formed to surround the entire outer edge 26 of the polishing surface 20. The slope surface 15 is connected to the polishing surface 20 so that an angle theta formed by the slope surface 15 and the polishing surface 20 inside the chemical mechanical polishing pad 10 is larger than 90° and smaller than 180° (i.e., obtuse angle). The angle theta is preferably 100° to 170°, and most preferably 110° to 150°. Since the angle theta formed by the polishing surface 20 and the side surface 24 is an obtuse angle, scratches that occur on the polishing target surface when the edge of the polishing surface 20 comes in contact with the polishing target surface can be reduced.

As shown in FIG. 2, the slope surface 15 may be linearly formed in the cross section perpendicular to the polishing surface 20. The depth a of the grooves 16 is equal to or smaller than a height b of the slope surface 15. The polishing surface wears away as chemical mechanical polishing progresses so that the height b of the slope surface 15 and the depth a of the grooves 16 decrease. In the chemical mechanical polishing pad 10 according to this embodiment, since the depth a of the grooves 16 is equal to or smaller than the height b of the slope surface 15, the angle theta formed by the polishing surface 20 and the slope surface 15 can be maintained even if the depth of the grooves 16 has changed due to wear. Therefore, occurrence of scratches can be suppressed even if the polishing surface has worn away to a large extent.

The height b of the slope surface 15 may be 0.1 mm or more. The height b of the slope surface 15 is preferably 0.1 to 2.5 mm, and more preferably 0.2 to 2.0 mm.

When the height b of the slope surface 15 is equal to the depth a of the groove 16, a thickness c of the area corresponding to the lower area of the side surface 24 can be made uniform over the entire polishing layer 11. Therefore, the strength of the chemical mechanical polishing pad 10 can be increased so that breakage can be suppressed.

The ratio e/d of a distance e between the outer edge 26 and the groove 16 closest to the outer edge 26 to the distance d is preferably 0.3 to 2, and more preferably 0.35 to 1.9. If the ratio e/d is less than 0.3, the thickness of the area outside the outermost groove 16 decreases. As a result, the polishing surface 20 may not maintain a flat state near the outer edge 26 of the chemical mechanical polishing pad 10 due to pressure applied during polishing so that scratches may occur on the polishing target surface. If the ratio e/d is larger than two, an area that is not provided with a slurry holding groove is formed over a wide range. Therefore, the polishing target surface is polished in a state in which an insufficient amount of slurry is supplied so that the number of scratches may increase. Moreover, since the area that is not provided with a groove increases as the polishing surface 20 wears away due to polishing, the number of scratches may increase.

The grooves 16 and the slope surface 15 may have a surface roughness (Ra) of 20 micrometers or less, preferably 0.05 to 15 micrometers, and more preferably 0.05 to 10 micrometers, for example. If the grooves 16 and the slope surface 15 have a surface roughness within the above range, scratches that occur on the polishing target surface during chemical mechanical polishing can be effectively suppressed.

The surface roughness (Ra) is defined by following expression (1).

$$Ra=\Sigma|Z-Z_{av}|/N \quad (1)$$

where, N is the number of measurement points, Z is the height of a rough curved surface, and $Z_{av}$ is the average height of a rough curved surface.

The chemical mechanical polishing pad 10 may include a section having a function other than the polishing function in addition to the polishing section. Examples of the section having a function other than the polishing function include a window section used to detect the end point using an optical end point detection device and the like. The window section may be formed using a material that has a transmittance of light having a wavelength of 100 to 300 nm of 0.1% or more (preferably 2% or more) at a thickness of 2 mm, or a material that has a cumulative transmittance of 0.1% or more (preferably 2% or more) in a wavelength band of 100 to 3000 nm. The material for the window section is not particularly limited insofar as the material satisfies the above-mentioned optical characteristics. For example, a material having the same composition as the material for the polishing layer 11 may be used.

A method of producing the polishing layer 11 of the chemical mechanical polishing pad 10 is not particularly limited. A method of forming the grooves or depressions that may be arbitrarily formed in the polishing layer 11 is not particularly limited. For example, a chemical mechanical polishing pad composition for the polishing layer 11 of the chemical mechanical polishing pad 10 may be provided in advance. The composition may be molded into a desired shape, and the grooves or the like may be formed by cutting. The outer shape of the polishing layer 11 and the grooves or the like may be formed at the same time by molding the chemical mechanical polishing pad composition using a mold provided with a pattern of the grooves or the like.

Modifications of the shape of the polishing layer 11 are described below. Modifications that are characterized by an area near the outer edge of the polishing layer are described below with reference to FIGS. 3 to 6.

Figure 3:
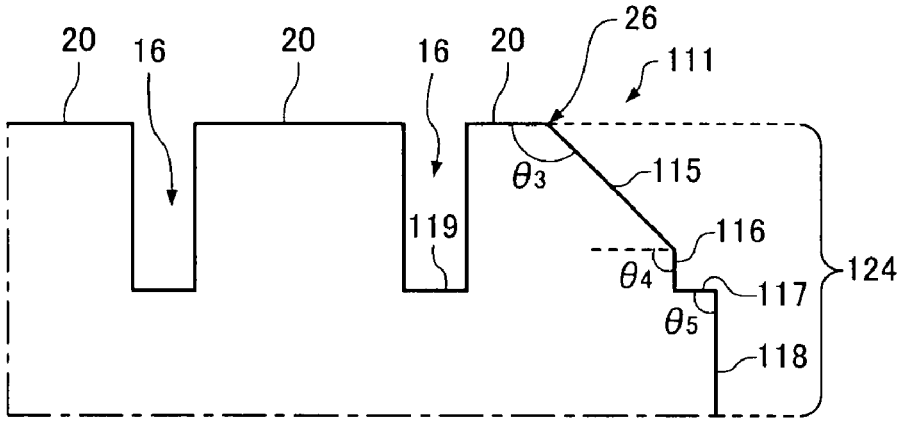
FIG. 3 is a cross-sectional view showing a detailed shape of a polishing layer according to a first modification.

FIG. 3 shows the cross section of a polishing layer 111 according to a first modification near the outer edge. FIG. 3 corresponds to FIG. 2. The side surface 24 of the polishing layer 11 according to this embodiment is formed by two surfaces including the slope surface 15. A side surface 124 according to the first modification is formed by four surfaces. Specifically, the side surface 124 has a first surface 115, a second surface 116, a third surface 117, and a fourth surface 118 in this order from the outer edge 26.

The first surface 115 is connected to the polishing surface 20 and the second surface 116 so that an angle $theta_3$ formed by the first surface 115 and the polishing surface 20 inside the chemical mechanical polishing pad 10 is larger than 90° and smaller than 180°, and the angle $theta_3$ faces the non-polishing surface. The angle $theta_3$ is preferably 100° to 170°.

The second surface 116 is connected to the first surface 115 and the third surface 117 so that an angle $theta_4$ formed by the second surface 116 and the polishing surface 20 inside the chemical mechanical polishing pad 10 is smaller than the angle formed by the first surface 115 and the polishing surface 20, and the angle $theta_4$ faces the non-polishing surface. The angle $theta_4$ may be 90°, for example.

The third surface 117 is parallel to the polishing surface 20 and is connected to the second surface 116 and the fourth surface 118. The third surface 117 is positioned at a height equal to that of a bottom 119 of the groove 16. Therefore, since the thickness of the area corresponding to the lower area of the side surface 124 can be made uniform over the entire polishing layer 111, the strength of the chemical mechanical polishing pad 10 can be increased so that breakage can be suppressed.

The fourth surface 118 is connected to the third surface 117 and the non-polishing surface 22 so that an angle $theta_5$ formed by the fourth surface 118 and the polishing surface 20 or the third surface 117 inside the chemical mechanical polishing pad 10 is smaller than the angle $theta_3$ formed by the first surface 115 and the polishing surface 20, and the angle $theta_5$ faces the non-polishing surface. The angle $theta_5$ may be 90°, for example.

The polishing layer 111 according to the first modification has the above-described shape. The remaining configuration of the polishing layer 111 is the same as the configuration of the polishing layer 11 described with reference to FIGS. 1 and 2. Therefore, description thereof is omitted.

Figure 4:
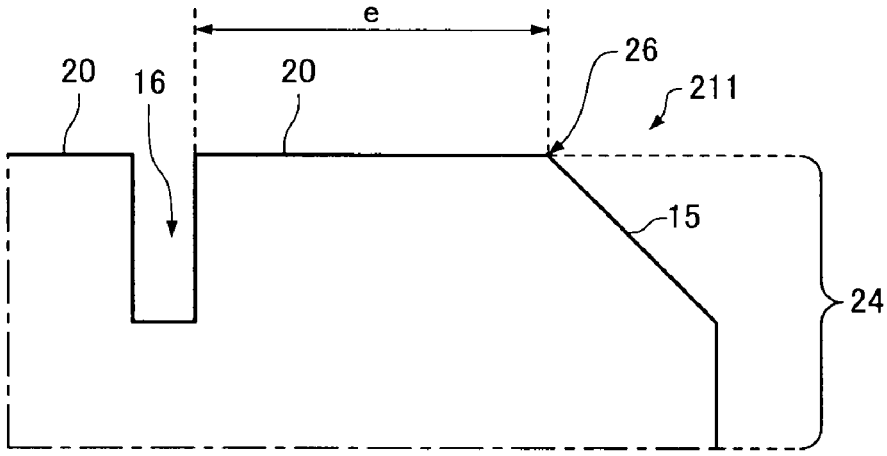
FIG. 4 is a cross-sectional view showing a detailed shape of a polishing layer according to a second modification.

FIG. 4 shows the cross section of a polishing layer 211 according to a second modification near the outer edge. FIG. 4 corresponds to FIG. 2. In the polishing layer 11 according to the above embodiment, the distance e between the outer edge 26 of the polishing surface 20 and the groove 16 is smaller than the distance d between the adjacent grooves 16. In the polishing layer 211 according to the second modification, the distance e between the outer edge 26 of the polishing surface 20 and the groove 16 is larger than the distance d between the adjacent grooves 16. According to this configuration, since the distance between the slope surface 15 and the groove 16 increases, a situation in which an area near the outer edge 26 has a sharp shape due to a small distance between the slope surface 15 and the groove 16 to damage the polishing target surface during polishing can be prevented.

The polishing layer 211 according to the second modification has the above-described shape. The remaining configuration of the polishing layer 211 is the same as the configuration of the polishing layer 11 described with reference to FIGS. 1 and 2. Therefore, description thereof is omitted.

Figure 5:
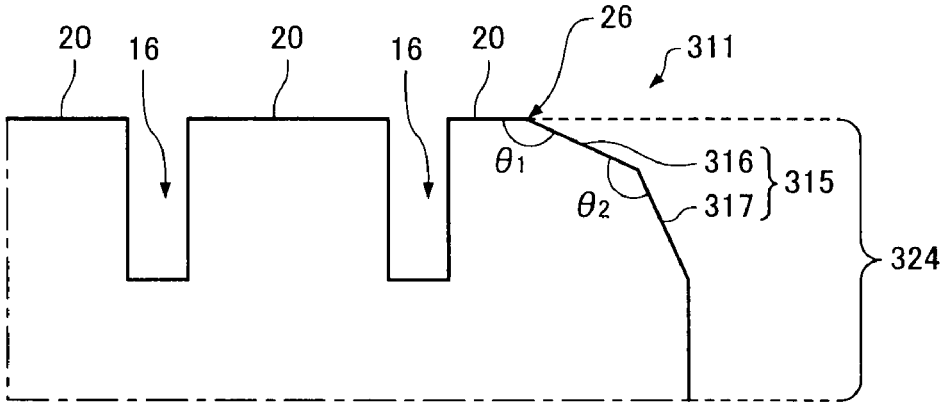
FIG. 5 is a cross-sectional view showing a detailed shape of a polishing layer according to a third modification.

FIG. 5 shows the cross section of a polishing layer 311 according to a third modification near the outer edge. FIG. 5 corresponds to FIG. 2. A side surface 324 of the polishing layer 311 according to the third modification differs from the side surface 24 of the polishing layer 11 according to this embodiment in that a slope surface 315 is formed by two slope surfaces. Specifically, the slope surface 315 is formed by a first slope surface 316 and a second slope surface 317, the angle formed by the first slope surface 316 and the polishing surface 20 differing from the angle formed by the second slope surface 317 and the polishing surface 20.

The first slope surface 316 is connected to the polishing surface 20 and the second slope surface 317 so that an angle $theta_1$ formed by the first slope surface 316 and the polishing surface 20 inside the chemical mechanical polishing pad 10 is larger than 90° and smaller than 180°, and the angle $theta_1$ faces the non-polishing surface.

The second slope surface 317 is connected to the first slope 316 so that an angle $theta_2$ formed by the second slope surface 317 and the polishing surface 20 inside the chemical mechanical polishing pad 10 is larger than 90° and smaller than 180°, and the angle $theta_2$ faces the non-polishing surface. The angle $theta_2$ is preferably smaller than the angle $theta_1$ ($theta_2 < theta_1$). Therefore, since the angle $theta_1$ can be increased without increasing the width of the slope surface 315, the area of the polishing surface 20 can be increased so that the polishing performance can be improved.

The polishing layer 311 according to the third modification has the above-described shape. The remaining configuration of the polishing layer 311 is the same as the configuration of the polishing layer 11 described with reference to FIGS. 1 and 2. Therefore, description thereof is omitted.

Figure 6:
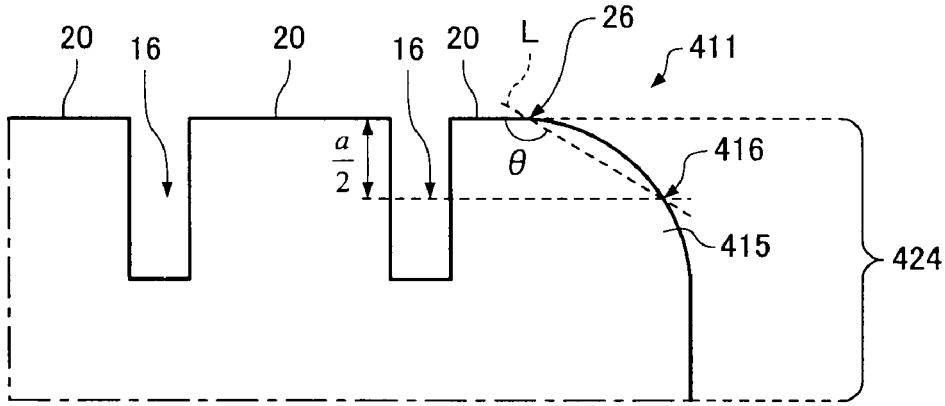
FIG. 6 is a cross-sectional view showing a detailed shape of a polishing layer according to a fourth modification.

FIG. 6 shows the cross section of a polishing layer 411 according to a fourth modification near the outer edge. FIG. 6 corresponds to FIG. 2. A side surface 424 of the polishing layer 411 according to the fourth modification differs from the side surface 24 of the polishing layer 11 according to this embodiment in that a slope surface 415 has a curved cross-sectional shape.

Since breakage of the edge of the polishing layer 11 can be suppressed by forming the slope surface 415 to have a curved cross-sectional shape (see FIG. 6), the life of the chemical mechanical polishing pad 10 can be increased. When the slope surface 415 has a curved cross-sectional shape (see FIG. 6), when a straight line that connects the outer edge 26 of the polishing surface 20 and a position 416 of the slope surface 415 at a depth corresponding to a value half of the depth of the groove 16 is referred to as a straight line L, the angle formed by the straight line L and the polishing surface 20 is set at theta, and the angle theta faces the non-polishing surface.

The polishing layer 411 according to the fourth modification has the above-described shape. The remaining configuration of the polishing layer 411 is the same as the configuration of the polishing layer 11 described with reference to FIGS. 1 and 2. Therefore, description thereof is omitted.

Modifications that are characterized by the shape of the grooves formed in the polishing layer are described below with reference to FIGS. 8 and 9.

Figure 8:
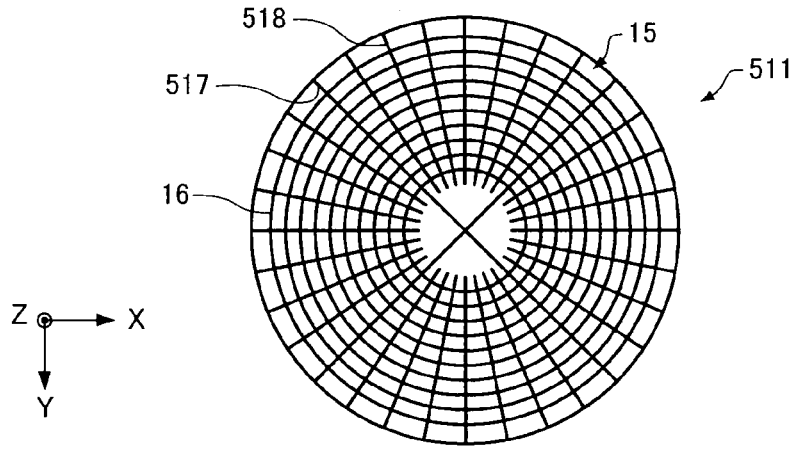
FIG. 8 is a view showing the top surface of a polishing layer 11 according to a fifth modification.

FIG. 8 shows the top surface of a polishing layer 511 according to a fifth modification. FIG. 8 corresponds to FIG. 7. The polishing layer 511 according to the fifth modification differs from the polishing layer 11 in that the polishing layer 511 further includes a plurality of grooves 517 and a plurality of grooves 518 that extend radially from the center area of the polishing surface 20 toward the outer edge in addition to the circular grooves 16. The term "center area of the polishing surface 20" used herein refers to an area enclosed by a circle having a radius of 50 mm and formed around the center of gravity of the polishing layer 511 as the center point. The grooves 517 and 518 extend from an arbitrary position in the center area toward the outer edge. The grooves 517 and 518 may have a linear shape, an arc shape, or a combination of these, for example.

The total number of grooves 517 and 518 may be 4 to 65, and preferably 8 to 48, for example. The grooves 517 and 518 may have the same cross-sectional shape and surface roughness as those of the grooves 16.

As shown in FIG. 8, four grooves 517 are provided linearly. The grooves 517 extend radially from the center of the polishing layer 511 to the side surface of the polishing layer 511. Seven grooves 517 are provided linearly between the grooves 517 (i.e., twenty-eight grooves are provided in total). The grooves 517 extend radially from a position (in the center area) displaced from the center toward the side surface, to the side surface of the polishing layer 511.

The polishing layer 511 according to the fifth modification has the above-described shape. The remaining configuration of the polishing layer 511 is the same as the configuration of the polishing layer 11 described with reference to FIGS. 1 and 2. Therefore, description thereof is omitted.

Figure 9:
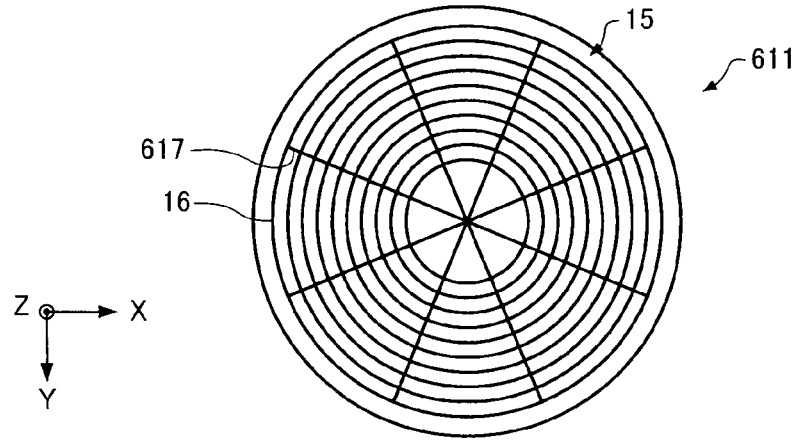
FIG. 9 is a view showing the top surface of a polishing layer 11 according to a sixth modification.

FIG. 9 shows the top surface of a polishing layer 611 according to a sixth modification. FIG. 9 corresponds to FIG. 7. The polishing layer 611 according to the sixth modification differs from the polishing layer 11 in that the polishing layer 611 further includes a plurality of grooves 617 that extend radially from the center of the polishing surface 20 toward the outer edge in addition to the circular grooves 16.

As shown in FIG. 9, eight grooves 617 are provided linearly. The grooves 617 extend radially from the center of the polishing layer 611 and reach the outermost groove 16. The grooves 617 do not extend to the side surface of the polishing layer 611. The grooves 617 may have the same cross-sectional shape and surface roughness as those of the grooves 16.

The polishing layer 611 according to the sixth modification has the above-described shape. The remaining configuration of the polishing layer 611 is the same as the configuration of the polishing layer 11 described with reference to FIGS. 1 and 2. Therefore, description thereof is omitted.

The shape of the grooves formed in the polishing layer is not limited to those described above. The grooves may have a spiral shape, a polygonal shape, or the like instead of a circular shape or a radial shape. The cross-sectional shape of the grooves is not limited to those described above. For example, the grooves may have a cross-sectional shape in the shape of the letter "V".

1.2. Material for Polishing Layer

The polishing layer 11 may be formed of an arbitrary material insofar as the polishing layer 11 satisfies the above-described requirements and the chemical mechanical polishing pad 10 exhibits its functions. Among the functions of the chemical mechanical polishing pad 10, it is preferable that pores (minute holes) that hold the chemical mechanical polishing aqueous dispersion during chemical mechanical polishing and temporarily store polishing waste be formed before polishing. Therefore, the polishing layer 11 is preferably formed of (I) a material that contains a water-insoluble matrix and water-soluble particles dispersed in the water-insoluble matrix, or (II) a material that contains a water-insoluble matrix and pores dispersed in the water-insoluble matrix.

When using the material (I), the water-soluble particles are dissolved or swell during chemical mechanical polishing upon contact with the chemical mechanical polishing aqueous dispersion, and the chemical mechanical polishing aqueous dispersion or the like can be held in pores formed in the water-insoluble matrix due to removal of the water-soluble particles. When using the material (II), the chemical mechanical polishing aqueous dispersion or the like can be held in the pores formed in advance.

The details of these materials are described below.

(I) Material that Contains Water-Insoluble Matrix and Water-Soluble Particles Dispersed in Water-Insoluble Matrix (A) Water-Insoluble Matrix The material for the water-insoluble matrix (A) is not particularly limited. It is preferable to use an organic material since an organic material can be easily molded to have a given shape and properties and can achieve moderate hardness, moderate elasticity, and the like. Examples of the organic material include a thermoplastic resin, an elastomer, rubber, a curable resin, and the like.

Examples of the thermoplastic resin include an olefin resin (e.g., polyethylene and polypropylene), a styrene resin (e.g., polystyrene), an acrylic resin (e.g., (meth)acrylate resin), a vinyl ester resin (excluding a (meth)acrylate resin), a polyester resin (excluding a vinyl ester resin), a polyamide resin, a fluororesin, a polycarbonate resin, a polyacetal resin, and the like.

Examples of the elastomer or rubber include a diene elastomer (e.g., 1,2-polybutadiene), an olefin elastomer (e.g., an olefin elastomer obtained by dynamically crosslinking an ethylene-propylene rubber and a polypropylene resin), a urethane elastomer, a urethane rubber (e.g., polyurethane rubber), a styrene elastomer (e.g., a styrene-butadiene-styrene block copolymer (hereinafter may be referred to as "SBS") and a hydrogenated product of a styrene-butadiene-styrene block copolymer (hereinafter may be referred to as "SEBS")), a conjugated diene rubber (e.g., high cis butadiene rubber, low cis butadiene rubber, isoprene rubber, styrene-butadiene rubber, styrene-isoprene rubber, acrylonitrile-butadiene rubber, and chloroprene rubber), ethylene-alpha-olefin rubber (e.g., ethylene-propylene rubber and ethylene-propylene-nonconjugated diene rubber), a butyl rubber, other rubbers (e.g., silicone rubber, fluororubber, nitrile rubber, chlorosulfonated polyethylene, acrylic rubber, epichlorohydrin rubber, and polysulfide rubber), and the like.

Examples of the curable resin include a heat-curable resin, a photocurable resin, and the like. Specific examples of the curable resin include a urethane resin, an epoxy resin, an unsaturated polyester resin, a polyurethane-urea resin, a urea resin, a silicon resin, a phenol resin, and the like.

These organic materials may be used either individually or in combination.

These organic materials may be modified to have an appropriate functional group. Examples of such a functional group include a group having an acid anhydride structure, a carboxyl group, a hydroxyl group, an epoxy group, an amino group, and the like.

It is preferable that these organic materials be partially or entirely crosslinked. If the water-insoluble matrix contains a crosslinked organic material, the water-insoluble matrix can be provided with a moderate elastic resilience so that displacement due to shearing stress applied to the chemical mechanical polishing pad 10 during chemical mechanical polishing can be suppressed. Moreover, a situation in which the pores are crushed when the water-insoluble matrix is stretched to a large extent and undergoes plastic deformation during chemical mechanical polishing and dressing (dressing process performed on the chemical mechanical polishing pad 10 at the same time as chemical mechanical polishing) or the surface of the chemical mechanical polishing pad is roughened to a large extent can be effectively prevented. Therefore, the pores are efficiently formed during dressing so that a decrease in the capability of holding the chemical mechanical polishing aqueous dispersion during polishing can be prevented. Moreover, a chemical mechanical polishing pad 10 that is roughened to only a small extent and can maintain flatness for a long period of time can be obtained.

As the crosslinked organic material, it is preferable that the water-insoluble matrix contain at least one material selected from a crosslinked thermoplastic resin and a crosslinked rubber (a crosslinked product of the above-mentioned rubber). It is more preferable that the water-insoluble matrix contain at least one material selected from a crosslinked diene elastomer, a crosslinked styrene elastomer, a crosslinked urethane elastomer, and a crosslinked conjugated diene rubber. It is particularly preferable that the water-insoluble matrix contain at least one material selected from crosslinked 1,2-polybutadiene, crosslinked SBS, crosslinked SEBS, crosslinked polyurethane, crosslinked styrene-butadiene rubber, crosslinked styrene-isoprene rubber, and crosslinked acrylonitrile-butadiene rubber. It is further preferable that the water-insoluble matrix contain at least one material selected from crosslinked 1,2-polybutadiene, crosslinked SBS, crosslinked SEBS, and crosslinked polyurethane.

When part of the organic material is crosslinked and the remaining organic material is not crosslinked, it is preferable that the water-insoluble matrix contain at least one material selected from a non-crosslinked thermoplastic resin and a non-crosslinked elastomer or rubber. It is more preferable that the water-insoluble matrix contain at least one material selected from a non-crosslinked olefin resin, a non-crosslinked styrene resin, a non-crosslinked diene elastomer, a non-crosslinked styrene elastomer, a non-crosslinked urethane elastomer, a non-crosslinked conjugated diene rubber, and a non-crosslinked butyl rubber. It is still more preferable that the water-insoluble matrix contain at least one material selected from non-crosslinked polystyrene, non-crosslinked 1,2-polybutadiene, non-crosslinked SBS, non-crosslinked SEBS, non-crosslinked polyurethane, non-crosslinked styrene-butadiene rubber, non-crosslinked styrene-isoprene rubber, and non-crosslinked acrylonitrile-butadiene rubber. It is particularly preferable that the water-insoluble matrix contain at least one material selected from non-crosslinked polystyrene, non-crosslinked 1,2-polybutadiene, non-crosslinked SBS, non-crosslinked polyurethane, and non-crosslinked SEBS.

When part of the organic material is crosslinked and the remaining organic material is not crosslinked, the content of the crosslinked organic material in the water-insoluble matrix is preferably 30 mass % or more, more preferably 50 mass % or more, and particularly preferably 70 mass % or more.

When part or the entirety of the organic material is crosslinked, the organic material may be crosslinked by a chemical crosslinking method, a radiation crosslinking method, a photo-crosslinking method, or the like. The chemical crosslinking method may be performed using an organic peroxide, sulfur, a sulfur compound, or the like as a crosslinking agent. The radiation crosslinking method may be carried out by applying electron beams or the like. The photo-crosslinking method may be carried out by applying ultraviolet rays or the like.

Among these, it is preferable to use the chemical crosslinking method. In this case, it is preferable to use the organic peroxide since the organic peroxide exhibits excellent handling properties and does not contaminate the polishing target during chemical mechanical polishing. Examples of the organic peroxide include dicumyl peroxide, diethyl peroxide, di-tert-butyl peroxide, diacetyl peroxide, diacyl peroxide, and the like.

When using the chemical crosslinking method, the crosslinking agent is preferably used in an amount of 0.01 to 3 parts by mass based on 100 parts by mass of the water-insoluble matrix subjected to a crosslinking reaction. A chemical mechanical polishing pad 10 that suppresses scratches during chemical mechanical polishing can be obtained using the crosslinking agent in an amount within the above range.

The entire material for the water-insoluble matrix may be crosslinked at one time, or part of the material for the water-insoluble matrix may be crosslinked and then mixed with the remaining material. Alternatively, a plurality of separately crosslinked products may be mixed.

A mixture of an organic material that is partially crosslinked can be easily obtained by one crosslinking operation by adjusting the amount of crosslinking agent and the crosslinking conditions (when using the chemical crosslinking method), or adjusting the dose of radiation (when using the radiation crosslinking method).

The water-insoluble matrix (A) may contain an appropriate compatibilizer in order to control the affinity of the water-insoluble matrix (A) with (B) water-soluble particles (described later) and the dispersibility of the water-soluble particles (B) in the water-insoluble matrix (A). Examples of the compatibilizer include a nonionic surfactant, a coupling agent, and the like.

(B) Water-Soluble Particles

The water-soluble particles (B) are removed from the water-insoluble matrix upon contact with the chemical mechanical polishing aqueous dispersion in the chemical mechanical polishing pad 10 to form pores in the water-insoluble matrix. The water-soluble particles (B) also have an effect of increasing the indentation hardness of the polishing base of the chemical mechanical polishing pad 10 to implement the desired Shore D hardness of the polishing base.

The water-soluble particles (B) are removed due to dissolution, swelling, and the like upon contact with water or an aqueous mixed medium contained in the chemical mechanical polishing aqueous dispersion.

It is preferable that the water-soluble particles (B) be solid bodies in order to increase the indentation hardness of the polishing layer 11 of the chemical mechanical polishing pad 10. Therefore, it is particularly preferable that the water-soluble particles be solid bodies that ensure that the chemical mechanical polishing pad 10 is provided with sufficient indentation hardness.

The material for the water-soluble particles (B) is not particularly limited. For example, organic water-soluble particles or inorganic water-soluble particles may be used. Examples of the material for the organic water-soluble particles include a saccharide (e.g., polysaccharide (e.g., starch, dextrin, and cyclodextrin), lactose, and mannitol), a cellulose (e.g., hydroxypropyl cellulose and methyl cellulose), a protein, polyvinyl alcohol, polyvinylpyrrolidone, polyacrylic acid, polyethylene oxide, a water-soluble photosensitive resin, sulfonated polyisoprene, a sulfonated polyisoprene copolymer, and the like. Examples of the material for the inorganic water-soluble particles include potassium acetate, potassium nitrate, potassium carbonate, potassium hydrogencarbonate, potassium chloride, potassium bromide, potassium phosphate, magnesium nitrate, and the like. It is preferable to use the organic water-soluble particles. In this case, it is preferable to use a polysaccharide (preferably cyclodextrin). It is particularly preferable to use beta-cyclodextrin.

These materials may be used either individually or in combination. One type of water-soluble particles formed of a specific material, or two or more types of water-soluble particles formed of different materials, may be used.

The average particle diameter of the water-soluble particles (B) is preferably 0.1 to 500 micrometers, and more preferably 0.5 to 100 micrometers. If the water-soluble particles (B) have a particle diameter within the above range, the size of pores formed by removal of the water-soluble particles (B) can be controlled within an appropriate range. Therefore, a chemical mechanical polishing pad 10 that exhibits an excellent capability of holding the chemical mechanical polishing aqueous dispersion and a high polishing rate during chemical mechanical polishing, and has excellent mechanical strength can be obtained.

The content of the water-soluble particles (B) is preferably 10 to 90 vol %, more preferably 15 to 60 vol %, and still more preferably 20 to 40 vol %, based on the total amount of the water-insoluble matrix (A) and the water-soluble particles (B). If the content of the water-soluble particles (B) is within the above range, a chemical mechanical polishing pad 10 that shows an excellent balance between the mechanical strength and the polishing rate can be obtained.

It is preferable that the water-soluble particles (B) be removed due to dissolution or swelling with water in the chemical mechanical polishing pad 10 only when the water-soluble particles (B) are exposed on the surface layer that comes in contact with the chemical mechanical polishing aqueous dispersion, and do not absorb moisture in the polishing layer 11. Therefore, the water-soluble particles (B) may have an outer shell that suppresses moisture absorption in at least part of the outermost area. The outer shell may be physically adsorbed on the water-soluble particles, or may be chemically bonded to the water-soluble particles, or may adhere to the water-soluble particles via physical adsorption and a chemical bond. Examples of the material for the outer shell include an epoxy resin, a polyimide, a polyamide, a polysilicate, and the like.

(II) Material that Contains Water-Insoluble Matrix and Pores Dispersed in Water-Insoluble Matrix When the polishing layer 11 is formed of the material (II) that contains a water-insoluble matrix and pores dispersed in the water-insoluble matrix, the polishing layer 11 may be formed of a foam made of a polyurethane, a melamine resin, a polyester, a polysulfone, polyvinyl acetate, or the like.

The average diameter of the pores dispersed in the water-insoluble matrix is preferably 0.1 to 500 micrometers, and more preferably 0.5 to 100 micrometers.

The shape of the polishing layer 11 is not particularly limited. For example, the polishing layer 11 may have a disc-like shape, a polygonal columnar shape, or the like. The shape of the polishing layer 11 may be appropriately selected corresponding to a polishing apparatus in which the chemical mechanical polishing pad 10 is installed.

A method of producing the chemical mechanical polishing pad composition is not particularly limited. For example, the chemical mechanical polishing pad composition may be produced by mixing necessary materials such as a specific organic material using a mixer or the like. In this case, a known mixer may be used. Examples of the mixer include a roller, a kneader, a Banbury mixer, an extruder (single-screw extruder and multi-screw extruder), and the like.

A polishing pad composition that contains the water-soluble particles for producing a polishing pad 10 that contains the water-soluble particles may be produced by mixing the water-insoluble matrix, the water-soluble particles, additives, and the like. The materials are normally mixed with heating in order to facilitate processing. It is preferable that the water-soluble particles be solid at the heating temperature during mixing. This enables the water-soluble particles having the above-mentioned average particle diameter to be dispersed in the water-insoluble matrix regardless of the mutual solubility with the water-insoluble matrix. Therefore, it is preferable to select the type of water-soluble particles corresponding to the processing temperature of the water-insoluble matrix.

1.3. Support Layer

In the chemical mechanical polishing pad 10, the support layer 12 is used to support the polishing layer 11 on the platen 13 of the polishing apparatus. The support layer 12 may be an adhesive layer or a cushion layer that has adhesive layers on the upper and lower sides.

The adhesive layer may be a pressure-sensitive adhesive sheet, for example. The thickness of the pressure-sensitive adhesive sheet is preferably 50 to 250 micrometers. If the pressure-sensitive adhesive sheet has a thickness of 50 micrometers or more, a pressure applied to the polishing surface of the polishing layer 11 can be sufficiently reduced. If the pressure-sensitive adhesive sheet has a thickness of 250 micrometers or less, a chemical mechanical polishing pad 10 having such a uniform thickness that the polishing performance is not affected by elevations or depressions can be obtained.

The material for the pressure-sensitive adhesive sheet is not particularly limited insofar as the polishing layer 11 can be secured on the platen. It is preferable to use an acrylic material or a rubber material having a modulus of elasticity lower than that of the polishing layer 11. It is more preferable to use an acrylic material for the pressure-sensitive adhesive sheet.

The adhesive strength of the pressure-sensitive adhesive sheet is not particularly limited insofar as the chemical mechanical polishing pad can be secured on the platen. It is preferable the pressure-sensitive adhesive sheet have an adhesive strength measured in accordance with JIS Z 0237 of 3 N/25 mm or more, more preferably 4 N/25 mm or more, and still more preferably 10 N/25 mm or more.

The material for the cushion layer is not particularly limited insofar as the material has a hardness lower than that of the polishing layer 11. The cushion layer may be formed of a porous body (foam) or a non-porous body. For example, a polyurethane foam or the like may be used as the material for the cushion layer. The thickness of the cushion layer is preferably 0.1 to 5.0 mm, and more preferably 0.5 to 2.0 mm.

2. Examples and Comparative Examples

Chemical mechanical polishing pads according to examples and chemical mechanical polishing pads according to comparative examples were produced, and chemical mechanical polishing was conducted using the chemical mechanical polishing pads. After polishing, the number of scratches caused by each chemical mechanical polishing pad was measured.

2.1. Production of Chemical Mechanical Polishing Pad (Examples 1 to 10 and 12 and Comparative Examples 4, 5, 11, 13, and 14)

72.8 parts by mass of 1,2-polybutadiene ("JSR RB830" manufactured by JSR Corporation) and 27.2 parts by mass of beta-cyclodextrin ("Dexy Pearl beta-100" manufactured by Bio Research Corporation of Yokohama, average particle diameter: 20 micrometers) were mixed for two minutes using an extruder heated to 160° C. After the addition of 0.55 parts by mass (equivalent to 0.30 parts by mass of dicumyl peroxide per 100 parts by mass of 1,2-polybutadiene) of "Percumyl D" (manufactured by NOF Corporation, dicumyl peroxide content: 40 mass %), the components were mixed at 120° C. for two minutes (60 pm) to obtain pellets of a chemical mechanical polishing pad composition. 1500 g of the pellets were heated at 170° C. for 18 minutes in a mold with a gap of 2.5 mm to obtain a circular tabular plate having a diameter of 762 mm and a thickness of 2.5 mm. The tabular plate was provided with grooves having a shape shown in FIG. 7 or 8 and a slope surface having a shape shown in one of FIGS. 2 to 6 using a commercially available grooving machine to obtain polishing layers according to Examples 1 to 10 and 12 and Comparative Examples 4, 5, 11, 13, and 14.

The groove width g, the groove depth a, the pitch (d+g), the distance e between the groove and the slope surface, and the angle theta of the slope surface of each polishing layer are shown in Table 1. In each example, the number of circular grooves was 147, and the diameter of the smallest groove was 10 mm. The number of radial grooves was 32 (see FIG. 8).

An adhesive layer (double-sided tape "#5673JX" manufactured by Sekisui Chemical Co., Ltd. (adhesive strength: 10 N/25 mm) having the same shape (circular) as the external shape of the polishing layer was bonded to the surface of the polishing layer in which the grooves were not formed.

2.2. Production of Chemical Mechanical Polishing Pad (Example 15)

A four-necked separable flask (2 L) equipped with a stirrer was charged with 50.2 parts by weight of polytetramethylene glycol ("PTMG-1000SN" manufactured by Hodogaya Chemical Co., Ltd., Mn=1000) and 15.6 parts by weight of hydroxy-terminated polybutadiene ("NISSO PB G-1000" manufactured by Nippon Soda Co., Ltd., Mn=1500) in air. The mixture was stirred at 60° C.

After the addition of 28.8 parts by weight of 4,4'-diphenylmethane diisocyanate ("MILLIONATE MT" manufactured by Nippon Polyurethane Industry Co., Ltd., dissolved in an oil bath at 80° C.), the components were mixed for 10 minutes with stirring. After the addition of 5.5 parts by weight of 1,4-butanediol ("14BG" manufactured by Mitsubishi Chemical Corp.), the components were mixed with stirring.

The resulting mixture was spread over a surface-treated SS vat, and annealed at 110° C. for one hour and at 80° C. for 16 hours to obtain polyurethane.

72.8 parts by mass of the polyurethane and 27.2 parts by mass of beta-cyclodextrin ("Dexy Pearl beta-100" manufactured by Bio Research Corporation of Yokohama, average particle diameter: 20 micrometers) were mixed for two minutes using an extruder heated to 160° C. After the addition of 2.8 parts by mass (equivalent to 1.5 parts by mass of dicumyl peroxide per 100 parts by mass of the polyurethane) of "Percumyl D" (manufactured by NOF Corporation, dicumyl peroxide content: 40 mass %), the components were mixed at 120° C. for two minutes (60 pm) to obtain pellets of a chemical mechanical polishing pad composition. A chemical mechanical polishing pad was obtained using the pellets in the same manner as in the production method described in "2.1. Production of chemical mechanical polishing pad (Examples 1 to 10 and 12 and Comparative Examples 4, 5, 11, 13, and 14)".

2.3. Production of Chemical Mechanical Polishing Pad (Comparative Examples 1 and 2)

A chemical mechanical polishing pad was obtained in the same manner as in the production method described in "2.1. Production of chemical mechanical polishing pad (Examples 1 to 10 and 12 and Comparative Examples 4, 5, 11, 13, and 14)", except that the slope surface was not formed.

2.4. Production of Chemical Mechanical Polishing Pad (Comparative Example 3)

A chemical mechanical polishing pad was obtained in the same manner as in the production method described in "2.3. Production of chemical mechanical polishing pad (Example 15)", except that the slope surface was not formed.

2.5 Chemical Mechanical Polishing

The chemical mechanical polishing pad produced in each of the sections 2.1. to 2.4. was placed on a platen of a chemical mechanical polishing apparatus ("Reflexion-LK" manufactured by Applied Materials), and a P-TEOS blanket wafer was subjected to chemical mechanical polishing. Chemical mechanical polishing was conducted until the edge of the pad was removed from the platen. The time from the start of chemical mechanical polishing to removal of the edge of the pad was measured. The chemical mechanical polishing conditions were as follows.

Chemical Mechanical Polishing Aqueous Dispersion: Silica Abrasive Grain-Containing Slurry ("CMS-1101" Manufactured by JSR Corporation)

Aqueous dispersion supply rate: 300 ml/min

Platen rotational speed: 63 rpm

Head rotational speed: 60 rpm

Head Pressure

Retaining ring pressure: 8 psi

Membrane pressure: 4.0 psi

Polishing time: 60 seconds

Number of wafers: 72/177

2.6. Evaluation 72 or 177 wafers were polished using the chemical mechanical polishing pad, and the number of scratches on the polishing target surface was then measured. The measurement results are shown in Table 1.

TABLE 1

| | Groove shape | shape of the slope surface | Angle theta (°) | Height b (mm) | Distance e (mm) | Width g (mm) | Depth a (mm) | Pitch (d + g) (mm) | Ratio e/d | Number of scratches (after polishing 72 wafers) | Number of scratches (after polishing 177 wafers) | Removal time (hours) |
|---|---|---|---|---|---|---|---|---|---|---|---|---|
| Example 1 | FIG. 7 | FIG. 2 | 125 | 1.4 | 0.5 | 0.5 | 1.4 | 2.0 | 0.33 | 234 | 280 | 60 or more |
| Example 2 | FIG. 7 | FIG. 2 | 125 | 1.4 | 0.5 | 0.25 | 1.4 | 1.5 | 0.4 | 263 | 326 | 60 or more |
| Example 3 | FIG. 8 | FIG. 2 | 125 | 1.4 | 0.5 | 0.5 | 1.4 | 2.0 | 0.33 | 301 | 392 | 60 or more |
| Example 4 | FIG. 7 | FIG. 2 | 125 | 1.4 | 1.0 | 0.5 | 1.4 | 2.0 | 0.67 | 289 | 342 | 60 or more |
| Example 5 | FIG. 7 | FIG. 4 | 125 | 1.4 | 2.5 | 0.5 | 1.4 | 2.0 | 1.67 | 253 | 258 | 60 or more |
| Example 6 | FIG. 7 | FIG. 2 | 115 | 1.4 | 0.5 | 0.5 | 1.4 | 2.0 | 0.33 | 256 | 351 | 60 or more |
| Example 7 | FIG. 7 | FIG. 2 | 115 | 1.4 | 1.0 | 0.5 | 1.4 | 2.0 | 0.67 | 270 | 349 | 60 or more |
| Example 8 | FIG. 7 | FIG. 4 | 115 | 1.4 | 2.0 | 0.25 | 1.4 | 1.5 | 1.6 | 264 | 291 | 60 or more |
| Example 9 | FIG. 7 | FIG. 5 | 135 | 1.4 | 0.5 | 0.5 | 1.4 | 2.0 | 0.33 | 325 | 413 | 60 or more |
| Example 10 | FIG. 7 | FIG. 6 | 150 | 1.4 | 0.5 | 0.5 | 1.4 | 2.0 | 0.33 | 291 | 428 | 60 or more |
| Comparative Example 11 | FIG. 7 | FIG. 2 | 125 | 1.4 | 0.05 | 0.5 | 1.4 | 2.0 | 0.03 | 334 | 400 | 60 or more |
| Example 12 | FIG. 7 | FIG. 4 | 125 | 1.4 | 2.8 | 0.5 | 1.4 | 2.0 | 1.87 | 282 | 384 | 60 or more |
| Comparative Example 13 | FIG. 7 | FIG. 2 | 125 | 1.4 | 0.3 | 0.5 | 1.4 | 2.0 | 0.2 | 367 | 451 | 60 or more |
| Comparative Example 14 | FIG. 7 | FIG. 4 | 125 | 1.4 | 3.5 | 0.5 | 1.4 | 2.0 | 2.3 | 340 | 414 | 60 or more |

TABLE 1-continued

| | Groove shape | shape of the slope surface | Angle theta (°) | Height b (mm) | Distance e (mm) | Width g (mm) | Depth a (mm) | Pitch (d + g) (mm) | Ratio e/d | Number of scratches (after polishing 72 wafers) | Number of scratches (after polishing 177 wafers) | Removal time (hours) |
|---|---|---|---|---|---|---|---|---|---|---|---|---|
| Example 15 | FIG. 7 | FIG. 2 | 125 | 1.4 | 0.5 | 0.5 | 1.4 | 2.0 | 0.33 | 205 | 238 | 60 or more |
| Comparative Example 1 | FIG. 7 | — | — | — | — | 0.5 | 1.4 | 2.0 | — | 508 | 629 | 23 |
| Comparative Example 2 | FIG. 8 | — | — | — | — | 0.5 | 1.4 | 2.0 | — | 545 | 655 | 20 |
| Comparative Example 3 | FIG. 7 | — | — | — | — | 0.5 | 1.4 | 2.0 | — | 513 | 601 | 27 |
| Comparative Example 4 | FIG. 7 | FIG. 2 | 125 | 1.4 | 0.3 | 0.5 | 1.7 | 2.0 | 0.2 | 281 | 512 | 40 |
| Comparative Example 5 | FIG. 7 | FIG. 2 | 125 | 1.4 | 3.5 | 0.5 | 1.7 | 2.0 | 2.3 | 378 | 573 | 45 |

In Table 1, the angle theta of Example 9 corresponds to the angle $theta_1$, and the angle $theta_2$ was set at 115°. The angle theta of Example 10 was less than 180°.

As shown in Table 1, the number of scratches on the polishing target surface after polishing 72 wafers using the chemical mechanical polishing pads according to Examples 1 to 15 was about 200 to 450. On the other hand, the number of scratches on the polishing target surfaces polished using the chemical mechanical polishing pads according to Comparative Examples 1 to 3 in which the slope surface was not formed was 500 or more. Regarding the number of scratches after polishing 177 wafers, the maximum difference in the number of scratches due to the presence or absence of the slope surface was about 430. In Comparative Examples 4 and 5 in which the wafers were polished using the chemical mechanical polishing pads having a shape in which the slope surface was formed but the depth a of the grooves was larger than the height b of the slope surface, the number of scratches after polishing 72 wafers could be suppressed. However, the number of scratches after polishing 177 wafers was significantly larger than those of Examples 1 to 10, 12, and 15 and Comparative Examples 11, 13, and 14.

When the angle theta was 125° or less, the numbers of scratches in Examples 1 to 8, 12, and 15 in which the ratio e/d was 0.3 to 2 was significantly smaller than the numbers of scratches in Comparative Examples 11, 13, and 14 in which the ratio e/d was outside the range of 0.3 to 2.

When the angle theta was 125° or less, the numbers of scratches in Examples 1 to 8, 12, and 15 in which the ratio e/d was 0.3 to 2 was significantly smaller than the numbers of scratches in Examples 11, 13, and 14 in which the ratio e/d was outside the range of 0.3 to 2.

Therefore, it was confirmed that occurrence of scratches can be significantly reduced and the effect can be maintained for a long period of time when the chemical mechanical polishing pad has the above-described slope surface and the depth a of the grooves is equal to or smaller than the height b of the slope surface.

In particular, the number of scratches on the polishing target surface can be more effectively reduced by polishing the polishing target surface using the chemical mechanical polishing pad that has a ratio e/d of 0.3 to 2 and an angle theta of 125° or less, and is provided with only the circular grooves (see FIG. 7).

The embodiments according to the invention have been described above. The invention includes configurations substantially the same as the configurations described in the above-described embodiments (in function, in method and effect, or in objective and effect). The invention also includes a configuration in which an unsubstantial element of the above-described embodiments is replaced by another element. The invention also includes a configuration having the same effects as those of the above-described configurations, or a configuration capable of achieving the same object as those of the above-described configurations. Further, the invention includes a configuration obtained by adding known technology to the above-described configurations.

What is claimed is:

1. A chemical mechanical polishing pad comprising:

a polishing surface;

a non-polishing surface that is provided opposite to the polishing surface;

a side surface that connects an outer edge of the polishing surface and an outer edge of the non-polishing surface; and a plurality of grooves formed in the polishing surface, wherein the side surface comprises a slope surface that is connected to the polishing surface, wherein a depth of the grooves is equal to or smaller than a height of the slope surface, wherein the polishing surface is circular, wherein the pad further comprises a plurality of circular grooves formed in the polishing surface, wherein the polishing surface is concentric with the plurality of circular grooves, and wherein a ratio, e/d, of a distance, e, between the outer edge of the polishing surface and the groove closest to the outer edge of the polishing surface to a distance, d, between adjacent grooves among the plurality of grooves is 0.3 to 2.

2. The pad of claim 1, wherein an angle theta formed by the polishing surface and the slope surface inside the pad is larger than 90° and smaller than 180°, and wherein the angle theta faces the non-polishing surface.

3. The pad of claim 1, wherein the slope surface comprises (i) a first slope surface and (ii) a second slope surface, an angle formed by the first slope surface (i) and the polishing surface differing from an angle formed by the second slope surface (ii) and the polishing surface;

wherein the first slope surface (i) is connected to the polishing surface and the second slope surface (ii) so that an angle $theta_1$ formed by the first slope surface (i) and the polishing surface inside the pad is larger than 90° and smaller than 180°, the angle $theta_1$ facing the non-polishing surface; and wherein the second slope surface (ii) is connected to the first slope surface (i) so that an angle $theta_2$ formed by the second slope surface (ii) and the first slope surface inside the pad is larger than 90° and smaller than 180°, the angle $theta_2$ facing the non-polishing surface.

4. The pad of claim 1, wherein the side surface comprises (i) a first surface, (ii) a second surface, (iii) a third surface, and (iv) a fourth surface, in this order from the outer edge of the polishing surface;

wherein the first surface (i) is connected to the polishing surface and the second surface (ii) so that an angle $theta_3$ formed by the first surface (i) and the polishing surface inside the pad is larger than 90° and smaller than 180°, the angle $theta_3$ facing the non-polishing surface;

wherein the second surface (ii) is connected to the first surface (i) and the third surface (iii) so that an angle $theta_4$ formed by the second surface (ii) and the polishing surface inside the pad is smaller than the angle $theta_3$ formed by the first surface (i) and the polishing surface, the angle $theta_4$ facing the non-polishing surface;

wherein the third surface (iii) is parallel to the polishing surface and is connected to the second surface (ii) and the fourth surface (iv); and wherein the fourth surface (iv) is connected to the third surface (iii) and the non-polishing surface so that an angle $theta_5$ formed by the fourth surface (iv) and the polishing surface or the third surface (iii) inside the pad is smaller than the angle formed by the first surface (i) and the polishing surface, the angle $theta_5$ facing the non-polishing surface.

5. The pad of claim 1, wherein the slope surface surrounds all of the entire outer edge of the polishing surface.

6. The pad of claim 1, having a pitch of 0.15 to 105 mm.

7. The pad of claim 6, wherein the pitch is 0.5 to 13 mm.

8. The pad of claim 6, wherein the pitch is 0.5 to 5.0 mm.

9. The pad of claim 6, wherein the pitch is 1.0 to 2.2 mm.

10. The pad of claim 2, wherein the angle theta is 100° to 170°.

11. The pad of claim 2, wherein the angle theta is 110° to 150°.

12. The pad of claim 1, wherein a height of the slope surface is 0.1 to 2.5 mm.

13. The pad of claim 1, wherein a height of the slope surface is 0.2 to 2.0 mm.

14. The pad of claim 1, wherein the ratio, e/d, is 0.35 to 1.9.

15. The pad of claim 1, wherein the ratio, e/d, is 0.35 to 1.87.

16. The pad of claim 1, wherein the ratio, e/d, is 0.35 to 1.67.

17. The pad of claim 1, wherein the ratio, e/d, is 0.35 to 1.6.

18. The pad of claim 1, wherein the polishing surface is crosslinked.

19. The pad of claim 1, wherein the polishing surface comprises 1,2-polybutadiene.

* * * * *